US010926165B2

(12) United States Patent
Shimel

(10) Patent No.: US 10,926,165 B2
(45) Date of Patent: Feb. 23, 2021

(54) GAME BOARD WITH UNREMOVABLE PIECES

(71) Applicant: Kyle David Shimel, Brookfield, WI (US)

(72) Inventor: Kyle David Shimel, Brookfield, WI (US)

( * ) Notice: Subject to any disclaimer, the term of this patent is extended or adjusted under 35 U.S.C. 154(b) by 0 days.

(21) Appl. No.: 16/830,805

(22) Filed: Mar. 26, 2020

(65) Prior Publication Data

US 2020/0368607 A1 Nov. 26, 2020

Related U.S. Application Data

(60) Provisional application No. 62/850,236, filed on May 20, 2019.

(51) Int. Cl.
*A63F 3/02* (2006.01)
*A63F 3/00* (2006.01)

(52) U.S. Cl.
CPC .. *A63F 3/00634* (2013.01); *A63F 2003/0063* (2013.01)

(58) Field of Classification Search
CPC ..... A63F 3/00634; A63F 2003/0063
USPC ..... 273/281, 241, 282.1, 282.3, 287
See application file for complete search history.

(56) References Cited

U.S. PATENT DOCUMENTS 1,518,178 A 12/1924 Chefko
2,454,639 A 11/1948 Edwards
3,130,972 A 4/1964 Schwarzlander
3,625,514 A * 12/1971 Haaland ..... A63F 7/047 473/512
3,672,679 A 6/1972 Burns
3,726,527 A * 4/1973 Schauffler ..... A63F 3/00088 273/256
3,727,916 A 4/1973 Miller
3,804,416 A 4/1974 Jones et al.
4,333,655 A 6/1982 Rudell et al.
4,434,982 A 3/1984 Bearint
4,470,601 A 9/1984 Finn
4,484,744 A * 11/1984 Gmunder ..... A63F 9/0857 273/153 S
4,486,017 A 12/1984 Evert, Jr.
4,526,372 A * 7/1985 Kikis ..... A63F 9/0857 273/153 S
4,708,348 A * 11/1987 Zaruba ..... A63F 3/00028 273/243
4,886,278 A 12/1989 Salter et al.
4,979,749 A 12/1990 Onanian
(Continued)

FOREIGN PATENT DOCUMENTS

GB 1231696 A * 5/1971 ..... A63F 3/00634

*Primary Examiner* — Vishu K Mendiratta
(74) *Attorney, Agent, or Firm* — Dunlap Bennett & Ludwig, PLLC; Brendan E. Squire

(57) ABSTRACT

A game board assembly includes a game board. The game board includes a base, sidewalls upstanding from the base, and a top wall coupled to the sidewalls. A track is defined through the game board. The game board assembly further includes a plurality of game pieces. Each of the game pieces includes a shaft, a head at a top of the shaft, and a foot at a bottom of the shaft. The shaft fits within and is slidable along the track. The head and the foot each include dimensions that inhibit removal of the game piece from the track.

17 Claims, 5 Drawing Sheets

(56) References Cited

U.S. PATENT DOCUMENTS

| | | | | |
|---|---|---|---|---|
| 4,993,715 | A * | 2/1991 | Brooking | A63F 9/083 273/153 S |
| 5,242,166 | A * | 9/1993 | Wong | A63F 9/0857 273/153 S |
| 5,427,379 | A | 6/1995 | Lee | |
| 5,497,997 | A | 3/1996 | Nikas et al. | |
| 5,687,970 | A | 11/1997 | Clark | |
| 5,775,693 | A | 7/1998 | Clancy | |
| 5,799,944 | A | 9/1998 | Lemmon | |
| 7,114,723 | B2 * | 10/2006 | Park | A63F 3/00214 273/258 |
| 2002/0109292 | A1 | 8/2002 | Serlachius | |
| 2005/0093244 | A1 * | 5/2005 | Olsen | A63F 3/00 273/450 |
| 2008/0169603 | A1 | 7/2008 | Zekaj | |
| 2017/0216715 | A1 | 8/2017 | Babras et al. | |

* cited by examiner

GAME BOARD WITH UNREMOVABLE PIECES

CROSS-REFERENCE TO RELATED APPLICATION

This application claims the benefit of priority of U.S. provisional application No. 62/850,236, filed May 20, 2019, the contents of which are herein incorporated by reference.

BACKGROUND OF THE INVENTION

The present invention relates to games and, more particularly, to a game board with attached pieces.

Many board games are on the market which share a common deficiency. The pieces placed on the game board are easily displaced from their desired game board positions. If a game board is inadvertently jostled, the pieces can be displaced so as to completely disturb the status and progress of the game. In this respect, it would be desirable if a board game were provided with game pieces that were not readily displaced from game board positions if the board is jostled.

There are board games which include magnetic boards and magnetic pieces. The attraction between the magnetic board and the magnetic pieces may be sufficient to prevent the pieces from being displaced from the board when the board is tilted slightly or lightly jostled, however such magnetic attraction is generally insufficient to withstand a relatively strong jostle. In this respect, it would be desirable if a board game were provided with game pieces that were more securely attached to a game board than by a magnetic attraction between the pieces and the board.

As can be seen, there is a need for a game board with unremovable pieces.

SUMMARY OF THE INVENTION

In one aspect of the present invention, a game board assembly comprises: a game board comprising a base, sidewalls upstanding from the base, and a top wall coupled to the sidewalls, wherein a track is defined through the game board, the track comprising at least a main track defined through the top wall, and a side track defined through at least one of the sidewalls, wherein the main track intersects with the side track; and a plurality of game pieces, each comprising a shaft, a head at a top of the shaft, and a foot at a bottom of the shaft, wherein the shaft fits within and is slidable along the track and the head and the foot each comprise dimensions that inhibit removal of the game piece from the track.

In another aspect of the present invention, a game board assembly comprises: a game board comprising a base, sidewalls upstanding from the base, and a top wall coupled to the sidewalls, wherein a track is defined through the game board, wherein the top wall comprises a plurality of levels comprising at least an upper level and a lower level, wherein the upper level and the lower level are connected by a riser, wherein the main track is defined through the upper level, the lower level, and the riser; and a plurality of game pieces, each comprising a shaft, a head at a top of the shaft, and a foot at a bottom of the shaft, wherein the shaft fits within and is slidable along the track and the head and the foot each comprise dimensions that inhibit removal of the game piece from the track.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Figure 1:
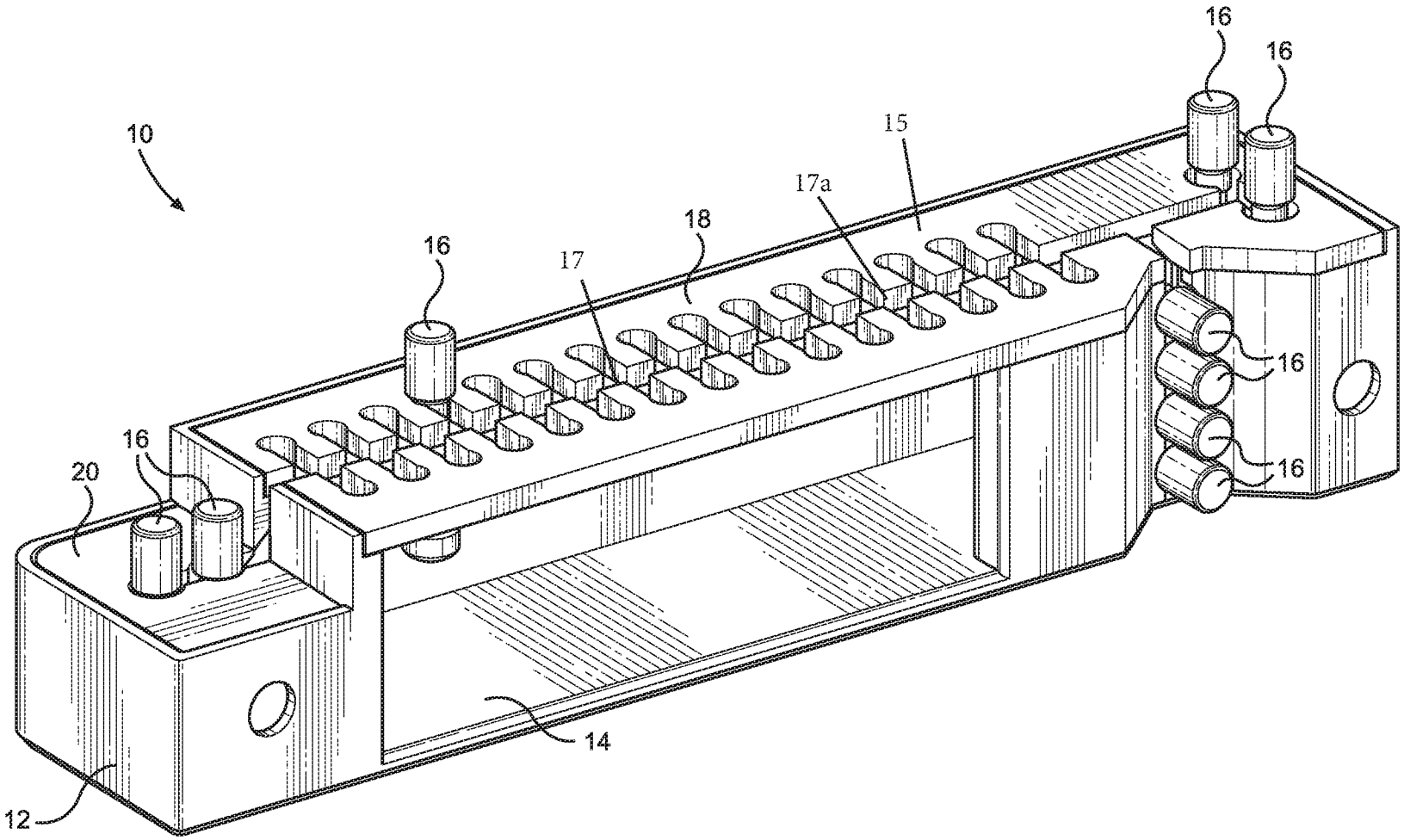
FIG. 1 is a perspective view of an embodiment of the present invention.
Figure 2:
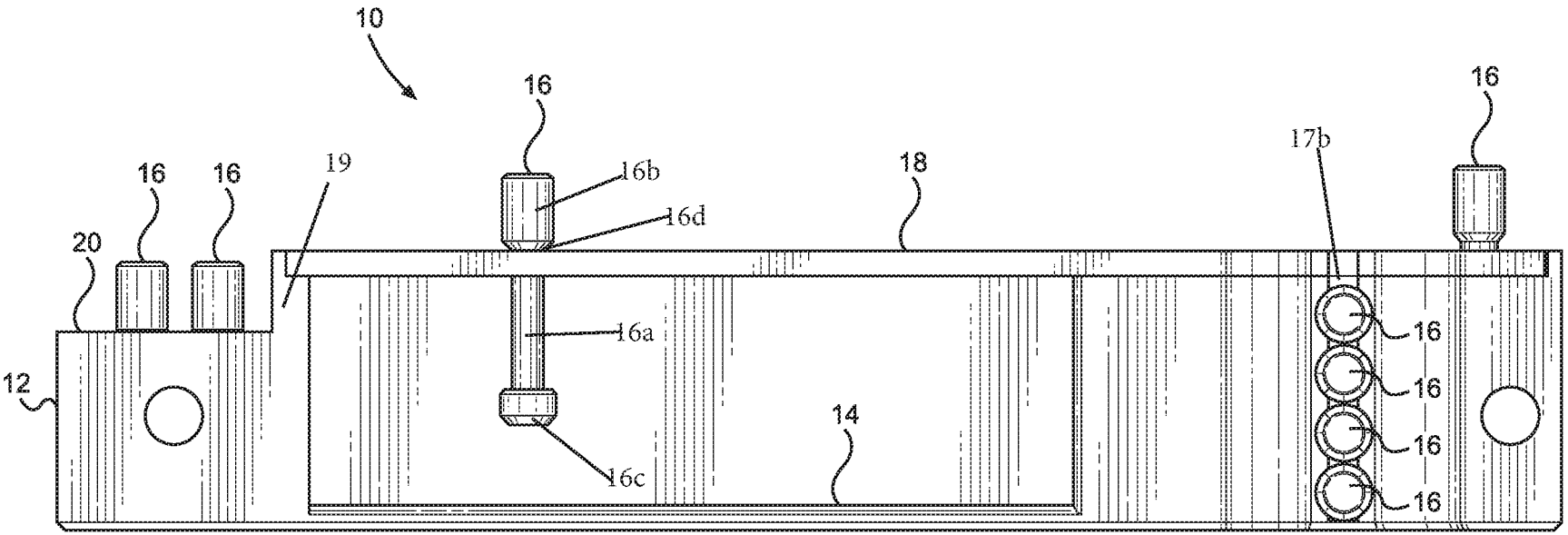
FIG. 2 is a side view of an embodiment of the present invention.
Figure 3:
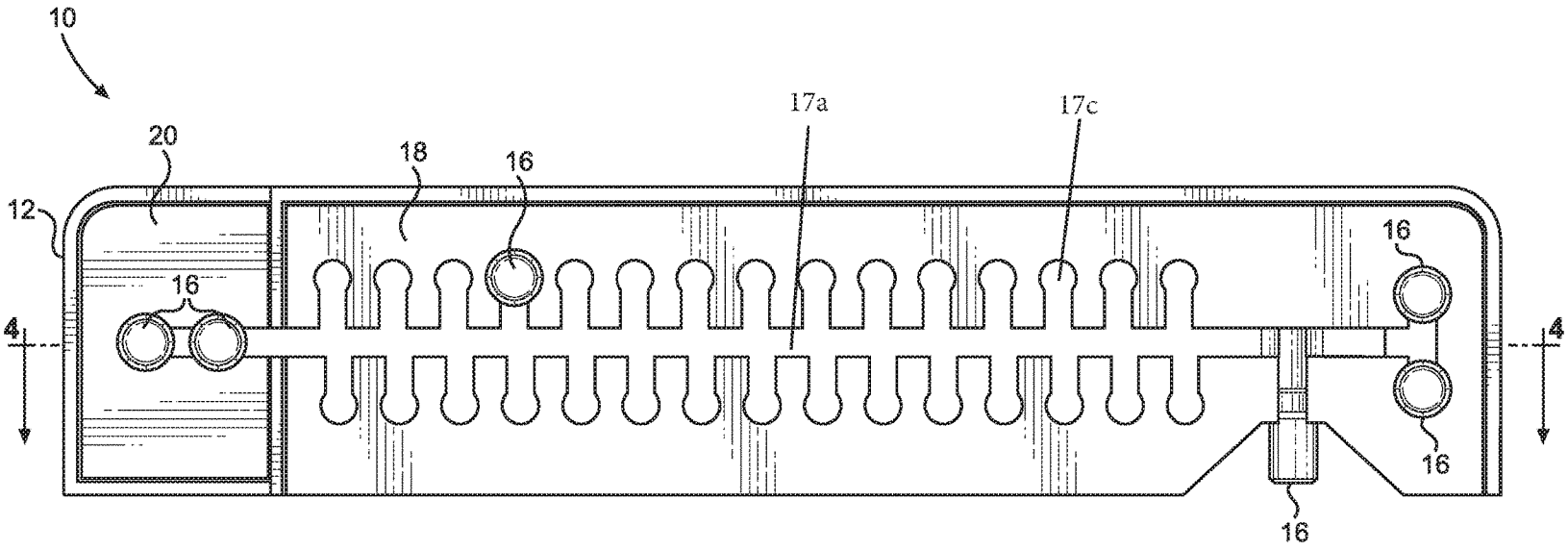
FIG. 3 is a top view of an embodiment of the present invention.
Figure 4:
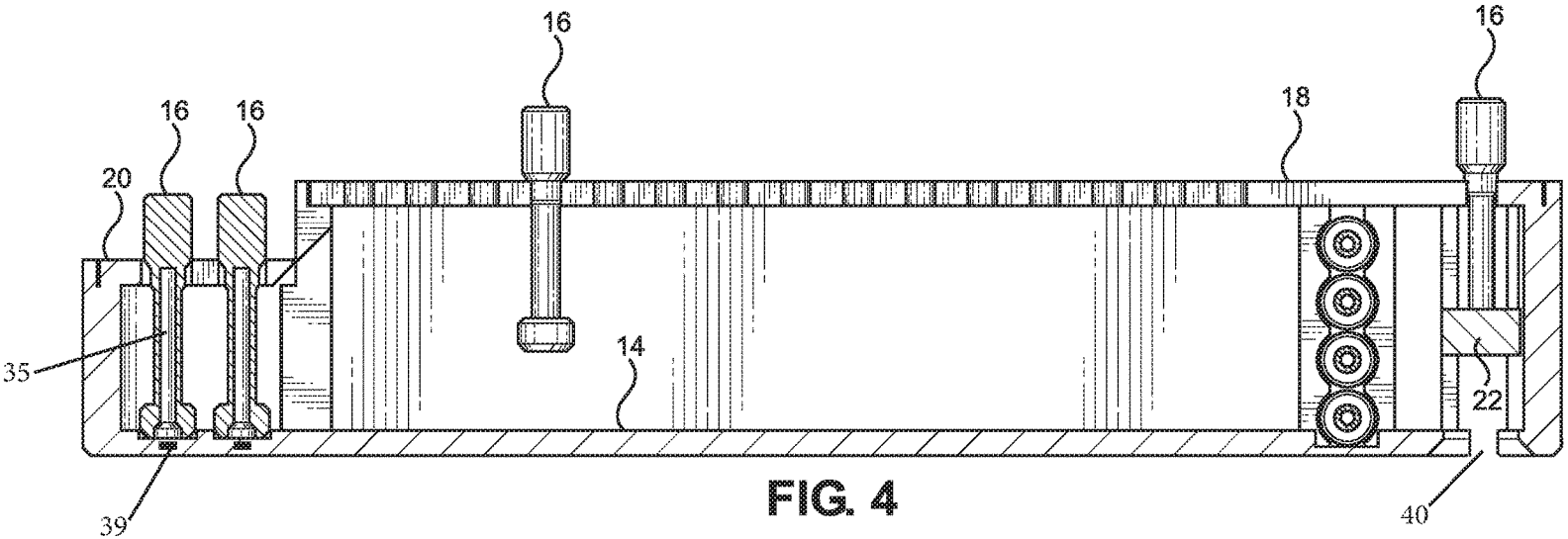
FIG. 4 is a cross sectional view of an embodiment of the present invention.
Figure 5A:
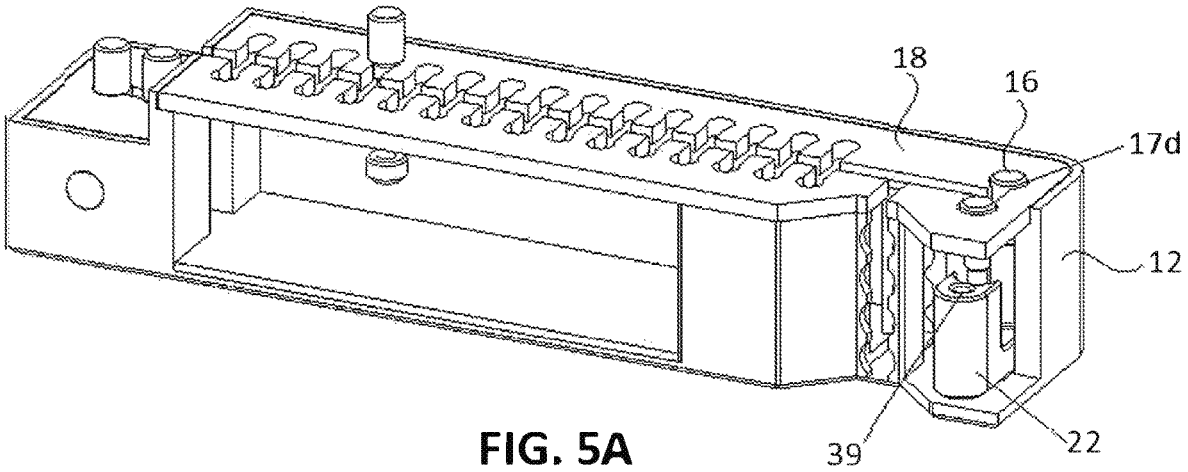
FIG. 5A is a perspective view of an embodiment of the present invention partially cut away to show the compartment and the lift with the game piece in a stowed position.
Figure 5B:
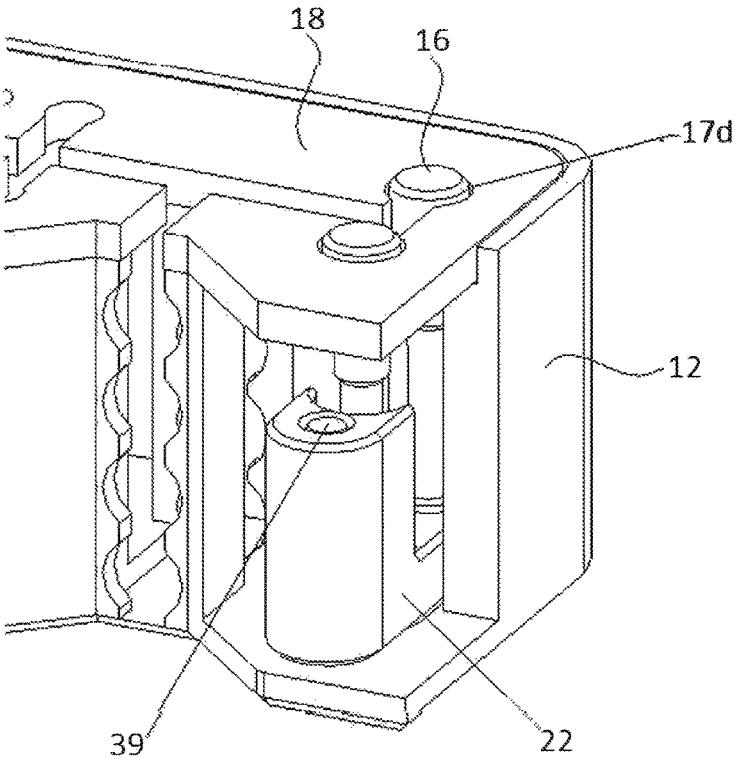
FIG. 5B is a detail perspective view of an embodiment of the present invention showing the compartment and the lift with the game piece in a stowed condition.
Figure 6A:
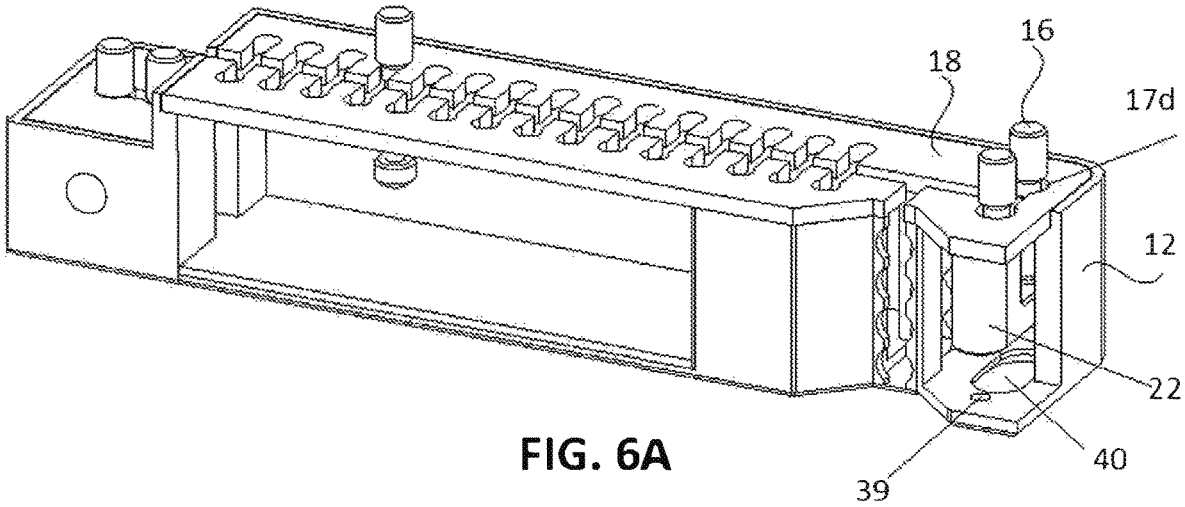
FIG. 6A is a perspective view of an embodiment of the present invention partially cut away to show the compartment and the lift with the game piece in an elevated condition.
Figure 6B:
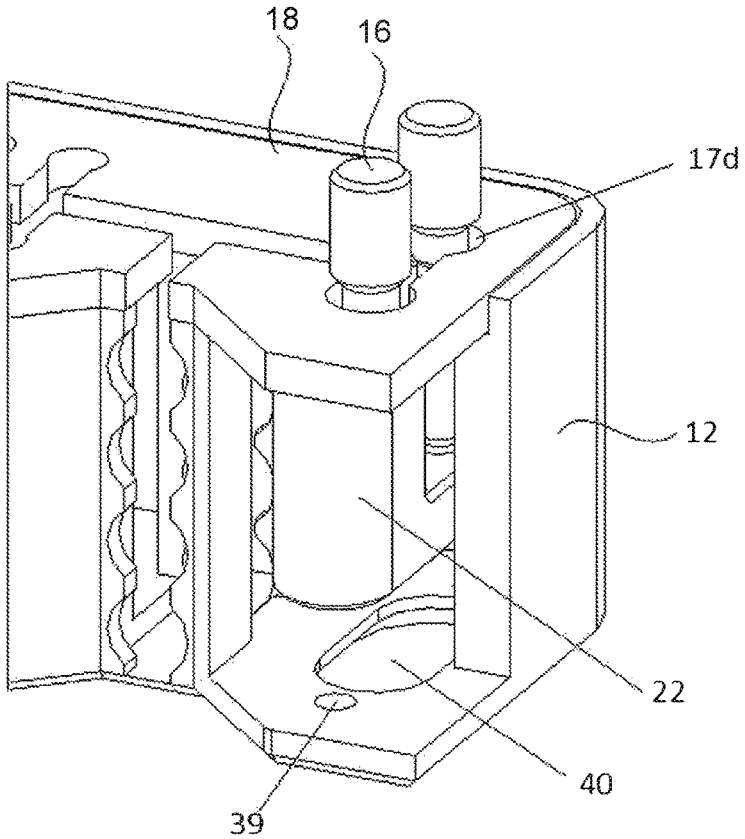
FIG. 6B is a detail perspective view of an embodiment of the present invention showing the compartment and the lift with the game piece in an elevated condition.

Referring to FIGS. 1 through 4, the present invention includes a game board assembly. The game board assembly includes a game board 10. The game board 10 includes a base 14, sidewalls 12 upstanding from the base 10, and a top wall 15 coupled to the sidewalls 12. A track 17 is defined through the game board 10. The game board assembly further includes a plurality of game pieces 16. Each of the game pieces 16 includes a shaft 16*a*, a head 16*b* at a top of the shaft 16*a*, a foot 16*c* at a bottom of the shaft 16*a*, and a neck 16*d* between the head 16*b* and shaft 16*a*. The shaft 16*a* fits within and is slidable along the track. The head 16*b* and the foot 16*c* each include dimensions that inhibit removal of the game piece 16 from the track 17.

The track 17 is a channel that is defined be inner edges of the game board 10. In certain embodiments, the track 17 includes at least a main track 17*a* defined through the top wall 15, and a side track 17*b* defined through at least one of the sidewalls 12. The main track 17*a* intersects with the side track 17*b*. The plurality of game pieces 16 may slide from the side track 17*b* to the main track 17*a*. In certain embodiments, the side track 17*b* may be used to store game pieces 16 that are not being used to play the game. However, the side track 17*b* may also be incorporated into playing the game and wrap around all sidewalls 12. The track 17 may further include a plurality of space tracks 17*c* extending laterally from the main track 17*a*. The space tracks 17*c* may each designate a space of a game board 10. Each of the space tracks 17*c* may include an end with circular opening. The neck 16*d* of each of the game pieces 16 may be tapered. The tapered portion may insert and nest within the circular opening, partially retaining the game piece 17*c* within the space of the game board 10.

The game board 10 of the present invention may be include a box shape, with the sidewalls 12 vertically disposed and the top wall 15 horizontally disposed relative to the base 14. In certain embodiments, the top wall 15 may include a plurality of levels 18, 20. For example, the present invention may include at least an upper level 18 and a lower level 20. The upper level 18 and the lower level 20 are connected together by a riser 19. The track 17 is defined through the upper level 18, the lower level 20, and the riser 19. Therefore, the game pieces 16 may slide from the upper level 18 through the riser 19 and to the lower level 20 and back from the lower level 20 through the riser 19 and to the upper level 18.

In certain embodiments, the lower level 20 may be used to store the game pieces 16. Each of the game pieces 16 may include a ferrous metal rod core 35. A portion of the base 14 beneath the lower level 20 may include a recess to receive a foot 16*c* of a game piece 16. The recess may include a magnet 39 which is attracted to the ferrous metal rod core 35. The magnet 39 thereby retains the foot 16*c* of the game piece within the recess.

In certain embodiments, a portion of the upper level 18 may be used to store the game pieces 16 on a lift 22. The lift 22 is disposed within internal sidewalls of the game board 10. The internal sidewalls define a compartment. The lift 22 friction fits within the compartment and is capable of sliding upwards and downwards within the compartment. The lift 22 may include a recess to receive the foot 16*c* of a game piece 16. The recess may include a magnet. The magnet is attracted to the ferrous metal rod core 35 and thereby retains the foot 16*c* of the game piece 16 within the recess of the lift 22. The lift 22 is allows the game pieces to be stored away while not in play and may be used to reveal the game piece 16 when game is in play. The game pieces 16 sit flush with the top wall 15 when the lift 22 is pushed downward and seated at the bottom of the base 14. This prohibits the game pieces from coming out of the track 17*c*. The lift 22 can be moved up by pushing from the bottom of the game board 10 through a small lift opening 40 defined through the base 14.

The game board 10 may further include a hollow center. An opening through one of the sidewalls 12 is an entrance to the hollow center. A door may be removably coupled to the game board 10 and selectively covers the opening. Therefore, cards or other game items may be stored within the game board 10 and removed when ready to play.

It should be understood, of course, that the foregoing relates to exemplary embodiments of the invention and that modifications may be made without departing from the spirit and scope of the invention as set forth in the following claims.

What is claimed is:

1. A game board assembly comprising:

a game board comprising a base, sidewalls upstanding from the base, and a top wall coupled to the sidewalls, wherein a track is defined through the game board, the track comprising at least a main track defined through the top wall, and a side track defined through at least one of the sidewalls, wherein the main track intersects with the side track;

a plurality of game pieces, each comprising a shaft, a head at a top of the shaft, and a foot at a bottom of the shaft, wherein the shaft fits within and is slidable along the track and the head and the foot each comprise dimensions that inhibit removal of the game piece from the track;

a compartment disposed within the sidewalls: and a lift having a lateral side carried in abutment with an interior face of at least one of the sidewalls, the lift operable to selectively raise and lower at least one of the plurality of game pieces between a stored position within the compartment and an elevated position for play on the game board.

2. The game board assembly of claim 1, wherein the sidewalls are vertically disposed and the top wall is horizontally disposed relative to the base.

3. The game board assembly of claim 1, wherein the top wall comprises a plurality of levels comprising at least an upper level and a lower level, wherein the upper level and the lower level are connected by a riser, wherein the track is defined through the upper level, the lower level, and the riser.

4. The game board assembly of claim 1, wherein the track further comprises a plurality of space tracks extending laterally from the main track, wherein the plurality of space tracks each designate a space of a game board.

5. The game board assembly of claim 4, wherein each of the plurality of space tracks comprise openings at an end, wherein each of the plurality of game pieces comprise a tapered neck that nests within the openings.

6. The game board assembly of claim 1, wherein the game board comprises a hollow center, wherein an opening through one of the sidewalls is an entrance to the hollow center.

7. The game board assembly of claim 6, further comprising a door removably coupled to the game board and covering the opening.

8. The game board assembly of claim 1, wherein each of the plurality of game pieces comprises a ferrous metal core, wherein the base comprises magnets that attract the ferrous metal cores.

9. The game board assembly of claim 1, further comprising:

a recess defined in the lift adapted to receive the foot of at least one of the plurality of game pieces.

10. The game board assembly of claim 1, further comprising:

a magnet coupled to the recess, the magnet configured to attract a ferrous metal core of the at least one of the plurality of game pieces.

11. A game board assembly comprising:

a game board comprising a base, sidewalls upstanding from the base, and a top wall coupled to the sidewalls, wherein a track is defined through the game board, wherein the top wall comprises a plurality of planar levels comprising at least an upper level and a lower level each disposed in a distinct parallel plane, wherein the upper level and the lower level are connected by a riser orthogonal to each of the plurality of planar levels, wherein the track is defined through the upper level, the lower level, and the riser; and a plurality of game pieces, each comprising a shaft, a head at a top of the shaft, and a foot at a bottom of the shaft, wherein the shaft fits within and is slidable along the track and the head and the foot each comprise dimensions that inhibit removal of the game piece from the track;

a compartment disposed within the sidewalls; and a lift carried within the compartment to selectively raise and lower at least one of the plurality of game pieces between a stored position within the compartment and an elevated position for play on the game board.

12. The game board assembly of claim 11 wherein the track comprises at least a main track defined through the top wall, and a side track defined through at least one of the sidewalls, wherein the main track intersects with the side track.

13. The game board assembly of claim 12, wherein the sidewalls are vertically disposed and the top wall is horizontally disposed relative to the base.

14. The game board assembly of claim 11, wherein the track further comprises a plurality of space tracks extending laterally from the main track, wherein the plurality of space tracks each designate a space of a game board.

15. The game board assembly of claim 11, wherein the game board comprises a hollow center, wherein an opening through one of the sidewalls is an entrance to the hollow center.

16. The game board assembly of claim 11, further comprising:

a recess defined in the lift adapted to receive the foot of at least one of the plurality of game pieces.

17. The game board assembly of claim 16, further comprising:

a magnet coupled to the recess, the magnet configured to attract a ferrous metal core of the at least one of the plurality of game pieces.

* * * * *